US011214071B2

(12) United States Patent
Fukasawa et al.

(10) Patent No.: US 11,214,071 B2
(45) Date of Patent: Jan. 4, 2022

(54) PRINTER AND INK SUPPLY UNIT

(71) Applicant: SEIKO EPSON CORPORATION, Tokyo (JP)

(72) Inventors: Koki Fukasawa, Shiojiri (JP); Toru Chino, Shiojiri (JP); Tomosuke Gomi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/832,537

(22) Filed: Mar. 27, 2020

(65) Prior Publication Data

US 2020/0307232 A1 Oct. 1, 2020

(30) Foreign Application Priority Data

Mar. 29, 2019 (JP) ..... JP2019-065970

(51) Int. Cl.
*B41J 2/175* (2006.01)
*B41J 29/13* (2006.01)
*B41J 29/02* (2006.01)

(52) U.S. Cl.
CPC ..... *B41J 2/17523* (2013.01); *B41J 2/17509* (2013.01); *B41J 2/17513* (2013.01); *B41J 2/17553* (2013.01); *B41J 29/13* (2013.01); *B41J 29/02* (2013.01); *B41J 2002/17573* (2013.01)

(58) Field of Classification Search
CPC .... B41J 2/175; B41J 2/17509; B41J 2/17513; B41J 2/1752; B41J 2/17523; B41J 2/17553; B41J 29/02; B41J 29/13; B41J 2002/17573
See application file for complete search history.

(56) References Cited

U.S. PATENT DOCUMENTS 6,378,971 B1 * 4/2002 Tamura ..... B41J 2/175 347/7
6,390,611 B1 * 5/2002 Kobayashi ..... B41J 2/175 347/84
6,502,932 B1 * 1/2003 Umemura ..... B41J 2/17503 347/86
9,662,890 B2 * 5/2017 Dan ..... B41J 2/17506
2006/0203047 A1 9/2006 Koga et al.
2018/0272731 A1 * 9/2018 Kimura ..... B41J 29/13

FOREIGN PATENT DOCUMENTS

JP 2006-247936 9/2006

* cited by examiner

*Primary Examiner* — Anh T Vo
(74) *Attorney, Agent, or Firm* — Workman Nydegger

(57) ABSTRACT

A printer is provided that includes a first ink storage unit storing ink, a second ink storage unit storing ink supplied from the first ink storage unit, a discharge head configured to discharge ink, a carriage configured to move the discharge head and the second ink storage unit, and a tube coupling the first ink storage unit and the second ink storage unit. The second ink storage unit includes an ink supplying port to which the tube is coupled, a communication hole communicating making inside and outside of the second ink storage unit communicate with each other, and a light-transmissive surface which is transparent or translucent. The communication hole and a portion of the light-transmissive surface are located at a position vertically higher than a front surface of the carriage in a state where the second ink storage unit is mounted on the carriage.

12 Claims, 7 Drawing Sheets

PRINTER AND INK SUPPLY UNIT

The present application is based on, and claims priority from JP Application Serial Number 2019-065970, filed Mar. 29, 2019, the disclosure of which is hereby incorporated by reference herein in its entirety.

BACKGROUND

The present disclosure relates to an ink supply unit and a printer including the ink supply unit.

One known printer, such as that disclosed in JP-A-2006-247936, is configured to print by discharging ink from a recording head. The recording head serves as an example of a discharge head. The printer includes a main tank, which is an example of a first ink storage unit, and a sub-tank, which is an example of a second ink storage unit that moves with the carriage. The printer drives a pump to pressurize ink stored in the main tank and pressure-feed the ink to the sub-tank.

The pump may also be manually actuated. However, manually feeding ink to the second ink storage unit may result in an excessive amount of ink entering the second ink storage unit and the ink overflowing from the second ink storage unit.

SUMMARY

According to one embodiment, a printer includes: a first ink storage unit configured to store ink, a second ink storage unit configured to store the ink supplied from the first ink storage unit, a discharge head configured to discharge the ink, a carriage configured to move the discharge head and the second ink storage unit, and a tube coupling the first ink storage unit and the second ink storage unit, the second ink storage unit including an ink supplying port to which the tube is coupled, a communication hole making inside and outside of the second ink storage unit communicate with each other, and a transparent or translucent light-transmissive surface, in which the ink stored in the second ink storage unit is visible from outside the second ink storage unit through the light-transmissive surface, and the communication hole and a portion of the light-transmissive surface are located at a position vertically higher than a side surface of the carriage in a state where the second ink storage unit is mounted on the carriage.

According to another embodiment, an ink supply unit includes a first ink storage unit configured to store ink, a second ink storage unit configured to store the ink supplied from the first ink storage unit, and a tube coupling the first ink storage unit and the second ink storage unit, the second ink storage unit including an ink supplying port to which the tube is coupled, a communication hole making inside and outside of the second ink storage unit communicate with each other, and a transparent or translucent light-transmissive surface, in which the ink stored in the second ink storage unit is visible from outside the second ink storage unit through the light-transmissive surface, and the communication hole and a portion of the light-transmissive surface are located at a position vertically higher than a side surface of a carriage in a stete where the second ink storage unit is mounted on the carriage, the carriage being configured to move a discharge head configured to discharge the ink.

DESCRIPTION OF EXEMPLARY EMBODIMENTS

First Embodiment

Figure 1:
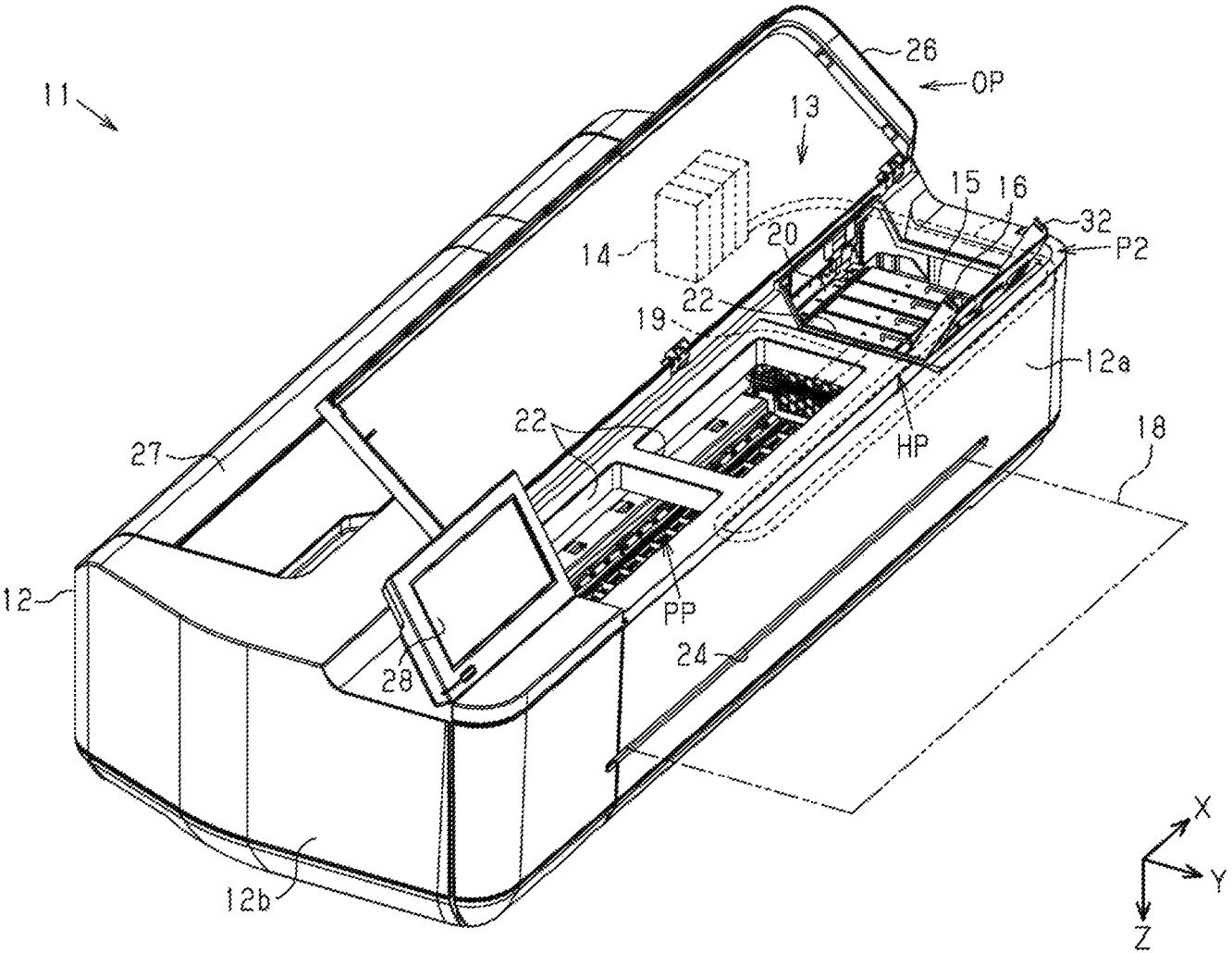
FIG. 1 is a perspective view of a first embodiment of a printer.

A first embodiment of an ink supply unit and a printer including the ink supply unit will be described below with reference to the drawings. The printer is an ink jet-type printer that prints text or images onto a medium such as a sheet of paper by ejecting ink onto the medium.

In the drawings, assuming that the printer 11 is placed on a horizontal surface, the direction of gravity is represented by the Z-axis and directions along a horizontal plane are represented by the X-axis and the Y-axis. The X-, Y-, and Z-axes are orthogonal to each other. In the following description, the direction along the X-axis is also referred to as a scanning direction X, the direction along the Y-axis is also referred to as "front", the direction opposite the front is also referred to as "rear", the direction along the Z-axis is also referred to as a vertically downward direction, and a direction opposite to the vertically downward direction is also referred to as a vertically upward direction.

As illustrated in FIG. 1, the printer 11 includes a housing 12 having a rectangular parallelepiped shape, and an ink supply unit 13. The ink supply unit 13 includes a first ink storage unit 14 that stores ink, a second ink storage unit 15 that stores ink supplied from the first ink storage unit 14, and a tube 16 that couples the first ink storage unit 14 and the second ink storage unit 15. The printer 11 according to the present embodiment is a color printer including a plurality of sets of the first ink storage unit 14, the second ink storage unit 15, and the tube 16 and is configured to print using ink of a plurality of colors. The printer 11 may also be a monochrome printer including one set of the first ink storage unit 14, the second ink storage unit 15, and the tube 16.

The first ink storage unit 14 may be disposed within the housing 12 or may be disposed outside of the housing 12. The first ink storage unit 14 may be a replaceable cartridge or may be a tank that can be filled with replacement ink. When some or all of the first ink storage unit 14, the second ink storage unit 15, and the tube 16 are formed of a transparent or translucent member, the user can visually recognize the amount of ink and the color of ink inside the printer 11 from outside the printer 11.

The printer 11 includes a discharge head 19 configured to discharge ink toward a medium 18, and a carriage 20 configured to move the discharge head 19 and the second ink storage unit 15 in the scanning direction X and a direction opposite to the scanning direction X. The second ink storage unit 15, the discharge head 19, and the carriage 20 are provided in the housing 12. The carriage 20 moves to a home position HP, a return position, and a printing position PP. The printing position PP is located between the home position HP and the return position in the scanning direction X. The return position, the printing position PP, and the home position HP are aligned in the scanning direction X in the stated order. The printing position PP is a position at which the discharge head 19, which moves with the carriage 20, prints on the medium 18. In the present embodiment, a position of the discharge head 19 facing the medium 18 and a position of the medium 18 able to face the discharge head 19 are also referred to as the printing position PP.

The housing 12 may have an opening 22 located vertically above the carriage 20 at the home position HP, which is an example of a predetermined position. The housing 12 may include a plurality of the openings 22. The opening 22 may be located vertically above the carriage 20 at the print position PP, which is an example of a predetermined position.

Figure 2:
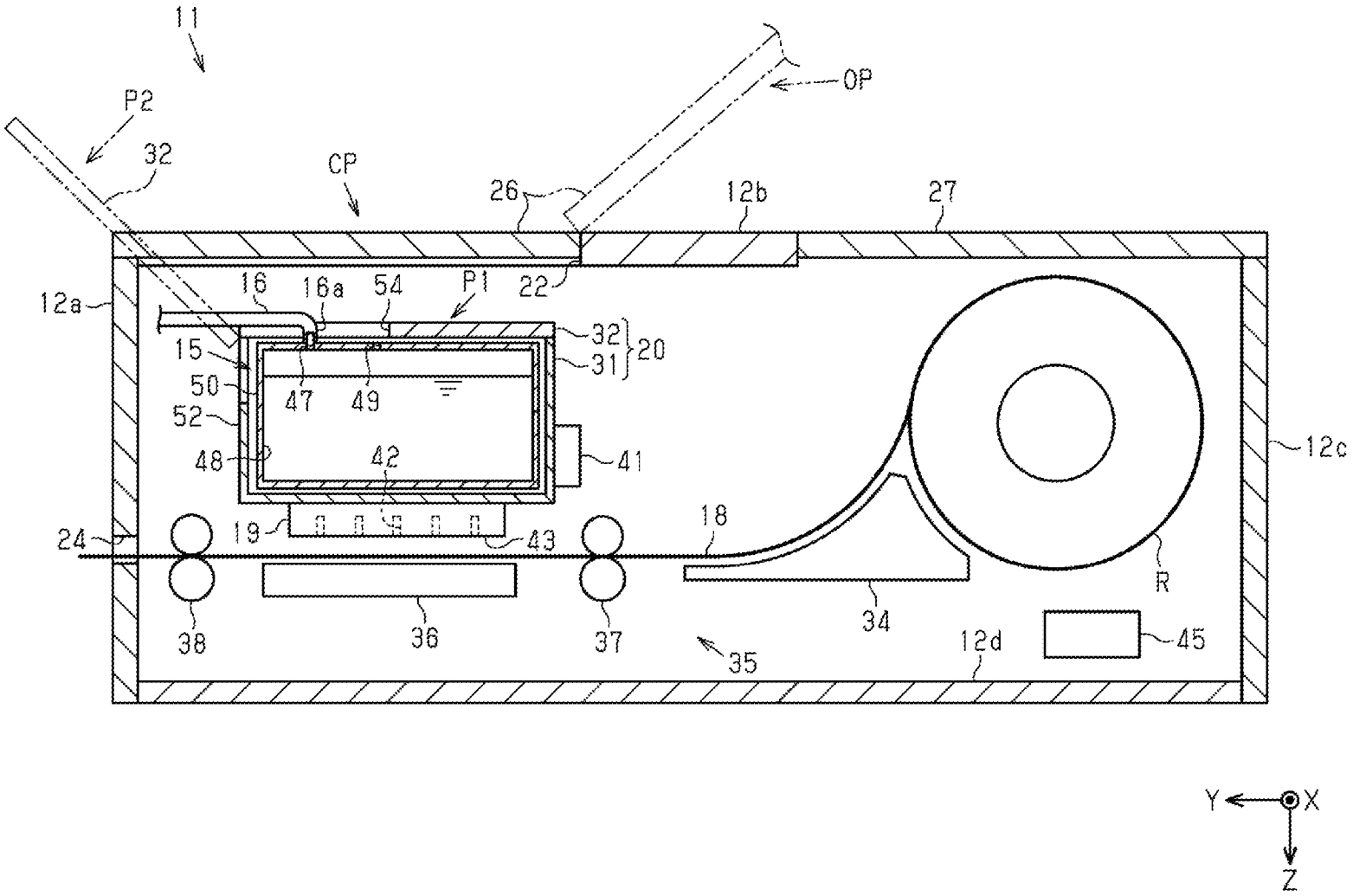
FIG. 2 is a schematic view illustrating the internal configuration of the printer.

As illustrated in FIGS. 1 and 2, the housing 12 includes a first outer cover member 12*a* located further forward than the carriage 20. The first outer cover member 12*a* is an example of an outer cover member. The first outer cover member 12*a* covers the front of the printer 11. The housing 12 includes a second outer cover member 12*b* that covers a vertically upper portion and sides of the printer 11, a third outer cover member 12*c* that covers the rear of the printer 11, and a fourth outer cover member 12*d* that covers a vertically lower portion of the printer 11.

As illustrated in FIG. 1, the first outer cover member 12*a* is provided with a discharge port 24 through which the printed medium 18 is discharged. The discharge port 24 has a shape that allows the medium 18 to be discharged and hinders external foreign material from entering the housing 12. In the present embodiment, the discharge port 24 has a slit shape with a small gap in the vertical direction.

The second outer cover member 12*b* may be provided with a printer cover 26, a rear cover 27, and a display unit 28 configured to display information. The printer cover 26, the rear cover 27, and the display unit 28 each have an axis parallel to the X-axis and are rotatable about that axis.

The printer cover 26 is able to move to a cover position CP indicated by the solid line in FIG. 2 and an open position OP illustrated in FIG. 1, which is different from the cover position CP. The axis of the printer cover 26 is located at a rear end of printer cover 26 when the printer cover 26 is at the cover position CP. The printer cover 26 covers the opening 22 when at the cover position CP. The printer cover 26 exposes the opening 22 when at the open position OP. When the printer cover 26 is at the open position OP, a user can perform maintenance on the second ink storage unit 15, the medium 18 located at the printing position PP, and other components through the opening 22.

The rear cover 27 pivots between a closed position illustrated in FIG. 1 and an open position (not shown). The axis of the rear cover 27 is located at a rear end of the rear cover 27 when the rear cover 27 is at the closed position. A user can load a roll body R (illustrated in FIG. 2), around which the medium 18 is wound into a cylindrical shape, to a space that is open when the rear cover 27 is at the open position.

As illustrated in FIG. 1, the display unit 28 rotates about an axis between a raised position illustrated in FIG. 1 and an inclined position that is inclined rearward from the raised position. The axis of the display unit 28 is located at the front end of the display unit 28. The display unit 28 faces forward when at the raised position. Thus, a user located in front of the display unit 28 can visually recognize information displayed on the display unit 28.

As illustrated in FIGS. 1 and 2, the carriage 20 may include a mounting portion 31 to which the second ink storage unit 15 is mounted, and a lid member 32. When the carriage 20 is at the home position HP, the lid member 32 is able to move to a first position P1 indicated by the solid line in FIG. 2 and a second position P2 indicated by the two-dot chain line in FIG. 2. The lid member 32 may be rotatable about an axis. The axis of the lid member 32 according to the present embodiment is located at a front end of the lid member 32 when the lid member 32 is at the first position P1, and is parallel to the X-axis. When the lid member 32 is at the first position P1, the lid member 32 is positioned vertically above the second ink storage unit 15 and limits attachment/detachment of the second ink storage unit 15 to/from the mounting portion 31. As illustrated in FIG. 1, when the lid member 32 is at the second position P2, the lid member 32 interferes with the opening 22 and limits movement of the carriage 20.

As illustrated in FIG. 2, the printer 11 includes a guide member 34 that guides the medium 18 fed from the roll body R, a transport unit 35 configured to transport the medium 18, and a support 36 that supports the medium 18 transported by the transport unit 35. The transport unit 35 transports the medium 18 fed from the roll body R downstream in the transport direction. Note that, in the present embodiment, the transport direction is a direction in which the medium 18 is transported along components of the printer 11, such as the guide member 34 and the support 36. The transport unit 35 includes a transport roller pair 37 provided between the guide member 34 and the support 36 in the transport direction, and a discharge roller pair 38 provided between the support 36 and the discharge port 24 in the transport direction. The transport roller pair 37 and the discharge roller pair 38 transport the medium 18 by rotating while sandwiching the medium 18.

The transport unit 35 transports the medium 18 fed from the roll body R downstream in the transport direction, and discharges the medium 18 from the discharge port 24 in the discharge direction. The discharge port 24 is located ahead of the printing position PP at which the discharge head 19 that moves with the carriage 20 prints on the medium 18. The transport unit 35 transports the medium 18 located at the printing position PP forward, and discharges the medium 18 forward from the discharge port 24. In other words, the transport direction and the discharge direction at the printing position PP coincide with the front.

The printer 11 includes a guide shaft 41 that supports the carriage 20. The discharge head 19 is mounted on the carriage 20 in a posture where a nozzle surface 43 on which a nozzle 42 is formed faces the support 36 or the medium 18 supported by the support 36. That is, the carriage 20 can reciprocate along the guide shaft 41.

The printer 11 includes a control unit 45 that centrally controls driving of each mechanism in the printer 11. The control unit 45 is configured of a processing circuit or the like including a computer and a memory, for example. The control unit 45 controls various operations executed by the printer 11 in accordance with programs stored in the memory.

As illustrated in FIG. 2, the second ink storage unit 15 includes an ink supplying port 47 coupled to a downstream end 16*a* of the tube 16, and a storage chamber 48 that stores supplied ink. The second ink storage unit 15 includes a communication hole 49 that communicates with both the inside and outside of the second ink storage unit 15, and a light-transmissive surface 50, which is a transparent or translucent surface. The communication hole 49 allows the inside of the storage chamber 48 to communicate with the outside. The light-transmissive surface 50 according to the present embodiment is a front side surface of the second ink storage unit 15. The ink stored in the second ink storage unit 15 can be viewed through the light-transmissive surface 50 from outside the second ink storage unit 15. In other words, the user can view the ink stored in the second ink storage unit 15 through the light-transmissive surface 50.

When the second ink storage unit 15 is mounted on the carriage 20, part of the light-transmissive surface 50 and the communication hole 49 in the second ink storage unit 15 are positioned vertically above a front face 52, which is an example of a side surface of the carriage 20, and are exposed from the carriage 20.

The front face 52 of the carriage 20 is an XZ-plane along the X- and Z-axes. Thus, the Y-axis direction is a normal direction orthogonal to the front face 52. The front face 52 is located between the light-transmissive surface 50 and the first outer cover member 12*a* in the Y-axis direction. The ink supplying port 47 is located closer to the light-transmissive surface 50 than the communication hole 49. In other words, the first outer cover member 12*a*, the front face 52 of the carriage 20, the light-transmissive surface 50, the ink supplying port 47, and the communication hole 49 are disposed in the printer 11 in the stated order from front to rear. In other words, the ink supplying port 47 is located between the communication hole 49 and the light-transmissive surface 50 in the Y-axis direction. The light-transmissive surface 50 is located between the ink supplying port 47 and the front face 52 of the carriage 20 in the Y-axis direction.

The lid member 32 has a notch 54. When the lid member 32 is at the first position P1, the lid member 32 covers a portion of the second ink storage unit 15 behind the communication hole 49 from the vertically upward direction. At this time, the communication hole 49 and the downstream end 16*a* of the tube 16 coupled to the ink supplying port 47 are positioned vertically below the notch 54 and are exposed from the lid member 32. When the lid member 32 is at the second position P2, the lid member 32 is located ahead of the second ink storage unit 15 and exposes the entire upper surface of the second ink storage unit 15. Thus, when the printer cover 26 is at the open position OP, the communication hole 49 and the downstream end 16*a* of the tube 16 in the second ink storage unit 15 are exposed regardless of the position of the lid member 32.

Next, actions of the present embodiment will be described.

In a standby state where printing is not performed, the carriage 20 is located at the home position HP. When the printer cover 26 is at the open position OP, the carriage 20 at the home position HP and the second ink storage unit 15 are exposed through the opening 22.

Figure 3:
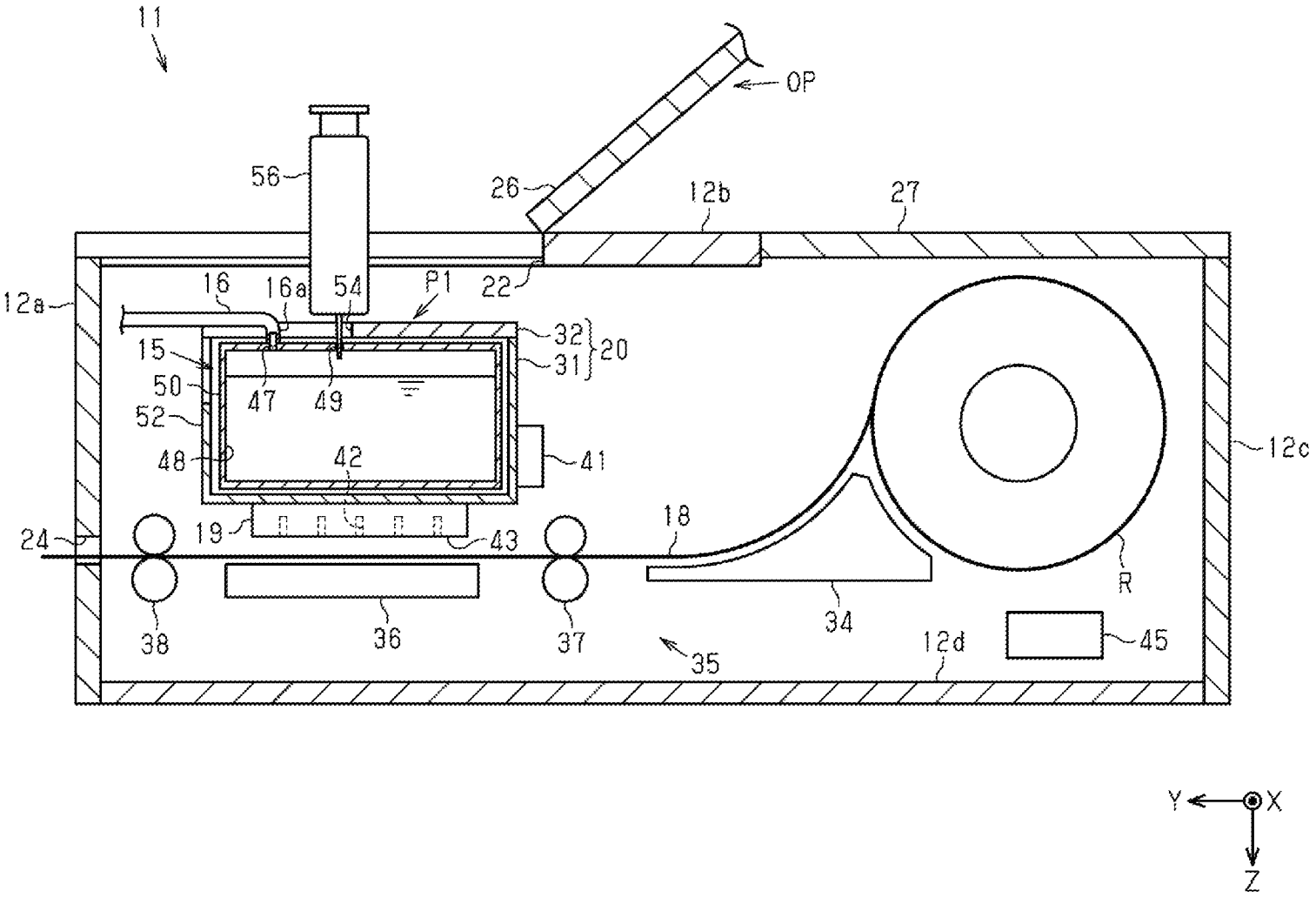
FIG. 3 is a schematic view of the printer in which a printer cover is at an open position.

More specifically, as illustrated in FIG. 3, when the printer cover 26 is at the open position OP, the light-transmissive surface 50, the communication hole 49, and the downstream end 16*a* of the tube 16 coupled to the ink supplying port 47 in the second ink storage unit 15 are exposed. Thus, the user can insert a syringe 56 into the communication hole 49 while the lid member 32 remains at the first position P1. When the storage chamber 48 is depressurized using the syringe 56, ink is drawn from the first ink storage unit 14 to the second ink storage unit 15 via the tube 16.

The first ink storage unit 14 may be disposed vertically above the second ink storage unit 15. After the tube 16 is filled with ink, the ink may be supplied from the first ink storage unit 14 to the second ink storage unit 15 based on the siphon principle.

Effects of the present embodiment will now be described.

(1) When the second ink storage unit 15 is mounted on the carriage 20, the communication hole 49 and a portion of the light-transmissive surface 50 in the second ink storage unit 15 are exposed. Thus, for example, when the second ink storage unit 15 is depressurized via the communication hole 49 and ink is drawn from the first ink storage unit 14 to the second ink storage unit 15, the amount of ink in the second ink storage unit 15 can be visually recognized through the light-transmissive surface 50. Accordingly, it is possible to reduce the risk of the ink supplied to the second ink storage unit 15 leaking from the second ink storage unit 15.

(2) The front surface 52 of the carriage 20 that covers a portion of the light-transmissive surface 50 is located between the light-transmissive surface 50 and the outer cover member formed with the discharge port 24. Thus, the light-transmissive surface 50 is easily visible from a direction in which the medium 18 discharged from the discharge port 24 is collected.

(3) The light-transmissive surface 50 is a front side surface of the second ink storage unit 15. Information displayed on the display unit 28 is visible from a position in front of the display unit 28. Thus, the light-transmissive surface 50 is easily visible from a direction in which information displayed on the display unit 28 is viewed.

(4) In a case where, for example, the second ink storage unit 15 is depressurized via the communication hole 49 and ink is drawn from the first ink storage unit 14 to the second ink storage unit 15, ink can be supplied from the first ink storage unit 14 to the second ink storage unit 15 using the siphon principle provided that the tube 16 can be filled with ink. In this regard, the ink supplying port 47 is positioned closer to the light-transmissive surface 50 than the communication hole 49. Thus, it is possible to reduce the risk of the syringe 56 used for depressurizing the inside of the second ink storage unit 15 through the communication hole 49 or the hand of an operator handling the syringe 56 covering the ink supplying port 47 and the tube 16 coupled to the ink supplying port 47. As a result, good operability can be ensured.

(5) The housing 12 includes the printer cover 26 that covers the opening 22 located vertically above the carriage 20. Thus, the communication hole 49 is covered by the printer cover 26 when the printer cover 26 is at the cover position CP, even if the communication hole 49 is exposed regardless of the position of the lid member 32. As a result, it is possible to reduce the risk of foreign material adhering to the communication hole 49 and foreign material entering the second ink storage unit 15 through the communication hole 49.

Second Embodiment

Next, a second embodiment of an ink supply unit and a printer including the ink supply unit will be described with reference to the drawings. Note that in this second embodiment the shapes of the second ink storage unit and the lid member are different from that of the first embodiment. Further, since other points are substantially the same as those of the first embodiment, duplicate descriptions of the same configuration will be omitted while assigning the same reference signs to the same components.

Figure 4:
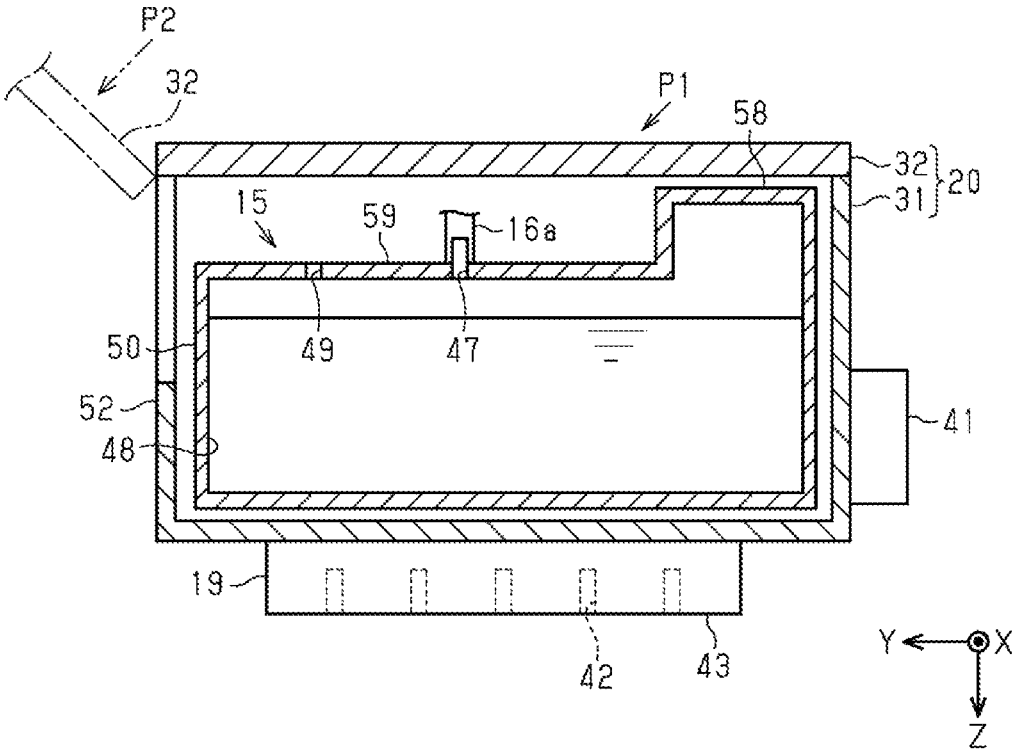
FIG. 4 is a schematic view of a second embodiment of a second ink storage unit and a carriage.

As illustrated in FIG. 4, the second ink storage unit 15 includes a high-back portion 58, and a low-back portion 59 having an upper end located vertically below the high-back portion 58. The low-back portion 59 is positioned in front of the high-back portion 58 and is located between the high-back portion 58 and the light-transmitting surface 50. The communication hole 49 and the ink supplying port 47 may be provided in the low-back portion 59. The communication hole 49 may be located closer to the light-transmissive surface 50 than the ink supplying port 47.

When the lid member 32 is at the first position P1 indicated by the solid line in FIG. 4, the lid member 32 may cover the entire upper surface of the second ink storage unit 15. That is, when the lid member 32 is at the first position P1, the lid member 32 may locate vertically above the ink supplying port 47 and cover the ink supplying port 47 and the communication hole 49. When the lid member 32 is at the second position P2 indicated by the two-dot chain line in FIG. 4, the lid member 32 exposes the communication hole 49 and the downstream end 16*a* of the tube 16 coupled to the ink supplying port 47.

Next, actions of the present embodiment will be described.

When the printer cover 26 is at the open position OP, the light-transmissive surface 50 of the second ink storage unit 15 and the lid member 32 located at the first position P1 are exposed through the opening 22, and the lid member 32 is able to move to the second position P2.

When the lid member 32 is at the second position P2, the communication hole 49 and the downstream end 16*a* of the tube 16 coupled to the ink supplying port 47 are exposed, and the syringe 56 can be inserted into the communication hole 49. That is, the ink is drawn into the second ink storage unit 15 while the printer cover 26 is positioned at the open position OP and the lid member 32 is positioned at the second position P2.

Effects of the present embodiment will now be described.

(6) The communication hole 49 is located closer to the light-transmissive surface 50 than the ink supplying port 47. The communication hole 49 is easily visible from the light-transmissive surface 50 side. Thus, for example, the user can easily visually recognize that ink is likely to adhere to the syringe 56 inserted into the communication hole 49, and it is possible to reduce the risk of ink adhering to the syringe 56. Additionally, even when ink has adhered to the syringe 56 inserted into the communication hole 49, the user can easily visually recognize that the ink has adhered to the syringe 56. Thus, it is possible to reduce the risk of ink splattering when the syringe 56 is withdrawn from the communication hole 49.

(7) The carriage 20 includes the lid member 32 that locates vertically above the communication hole 49 and covers the communication hole 49. Thus, it is possible to reduce the risk of foreign material adhering to the communication hole 49 and foreign material entering the second ink storage unit 15 through the communication hole 49.

(8) When the lid member 32 is at the first position P1 the lid member 32 locates vertically above the ink supplying port 47 and covers the ink supplying port 47. Thus, it is possible to reduce the risk of, for example, an external force acting on the coupling portion between the ink supplying port 47 and the tube 16 and, as a result, the tube 16 becoming detached from the ink supplying port 47.

The present exemplary embodiment described above may be modified as follows. The present exemplary embodiment and modified examples thereof to be described below may be implemented in combination within a range in which a technical contradiction does not arise.

Figure 5:
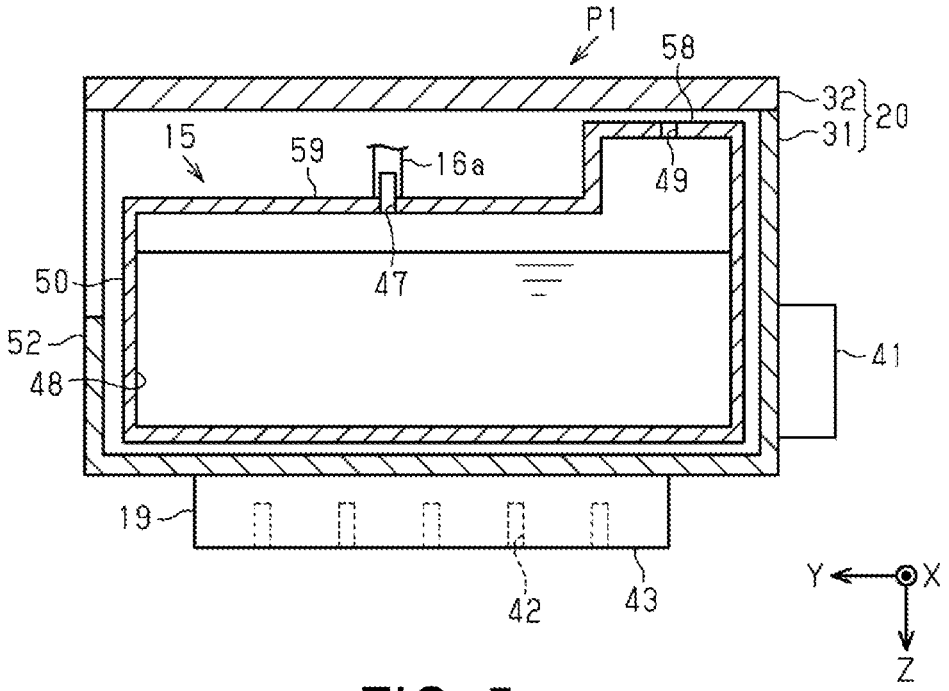
FIG. 5 is a schematic view of modification examples of the second ink storage unit and the carriage.

As illustrated in FIG. 5, the second ink storage unit 15 may have a configuration in which the communication hole 49 is provided in the high-back portion 58 and the ink supplying port 47 is provided in the low-back portion 59.

Figure 6:
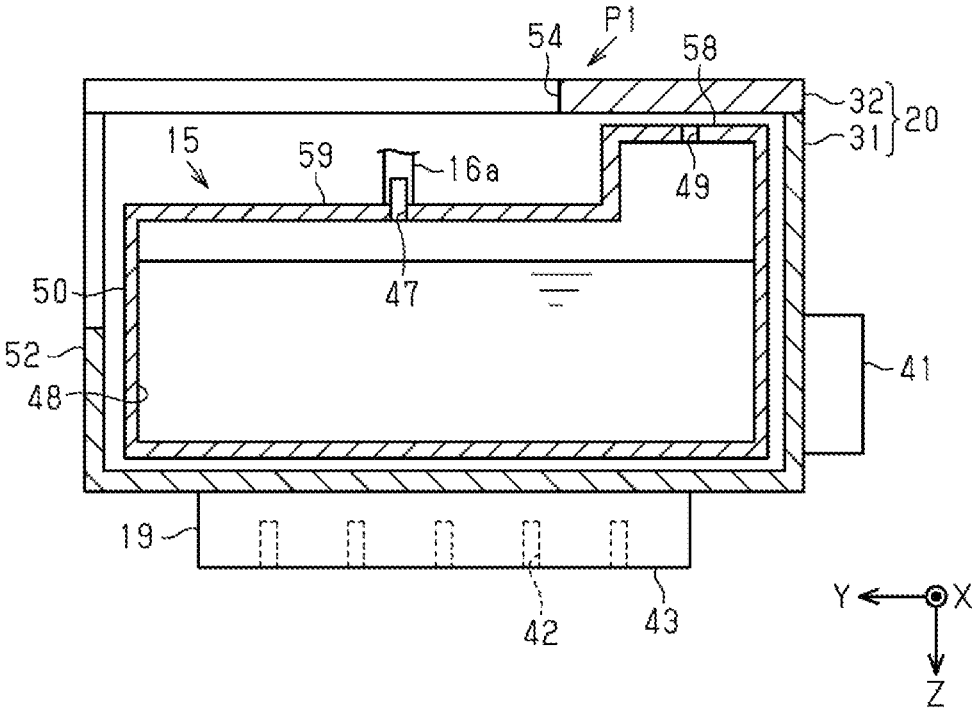
FIG. 6 is a schematic view of modification examples of the second ink storage unit and the carriage.

As illustrated in FIG. 6, the lid member 32 may include the notch 54 that is positioned vertically above the ink supplying port 47 when the lid member 32 is at the first position P1. The lid member 32 may expose the downstream end 16*a* of the tube 16 coupled to the ink supplying port 47 at any position. In other words, the lid member 32 may be configured so as to expose the downstream end 16*a* of the tube 16 regardless of the position of the lid member 32. The lid member 32 may also be configured so as to locate a vertically above the communication hole 49 and cover the communication hole 49 when at the first position P1 and expose the communication hole 49 when at the second position P2.

Figure 7:
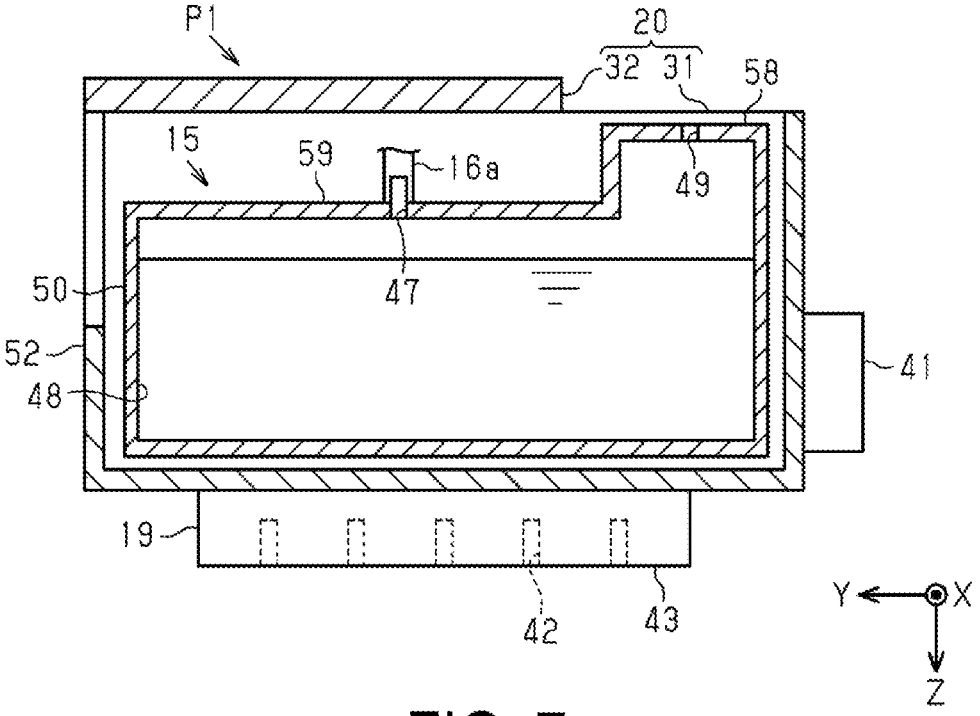
FIG. 7 is a schematic view of modification examples of the second ink storage unit and the carriage.

As illustrated in FIG. 7, the length of the lid member 32 in the Y-axis direction may be shorter than the length of the second ink storage unit 15 in the Y-axis direction. That is, when the lid member 32 is at the first position P1, the lid member 32 may have dimensions so as to cover only the ink supplying port 47 and expose the communication hole 49.

Figure 8:
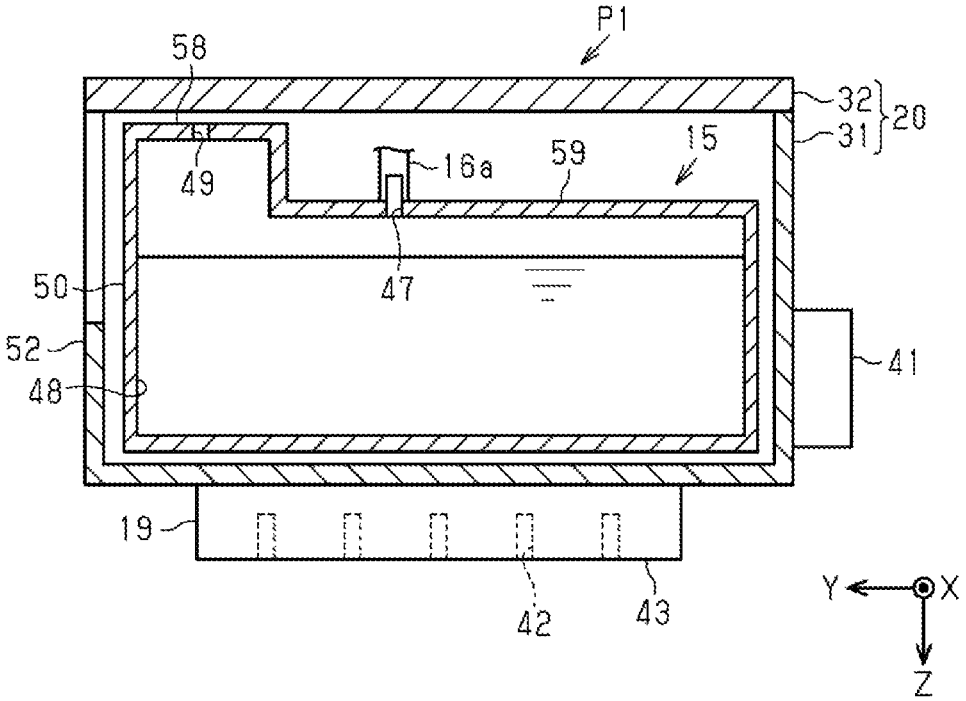
FIG. 8 is a schematic view of modification examples of the second ink storage unit and the carriage.

As illustrated in FIG. 8, the high-back portion 58 may be located between the low-back portion 59 and the light-transmissive surface 50. The communication hole 49 may be provided in the high-back portion 58 and may be located further forward than the ink supplying port 47 and further rearward than the light-transmissive surface 50.

Figure 9:
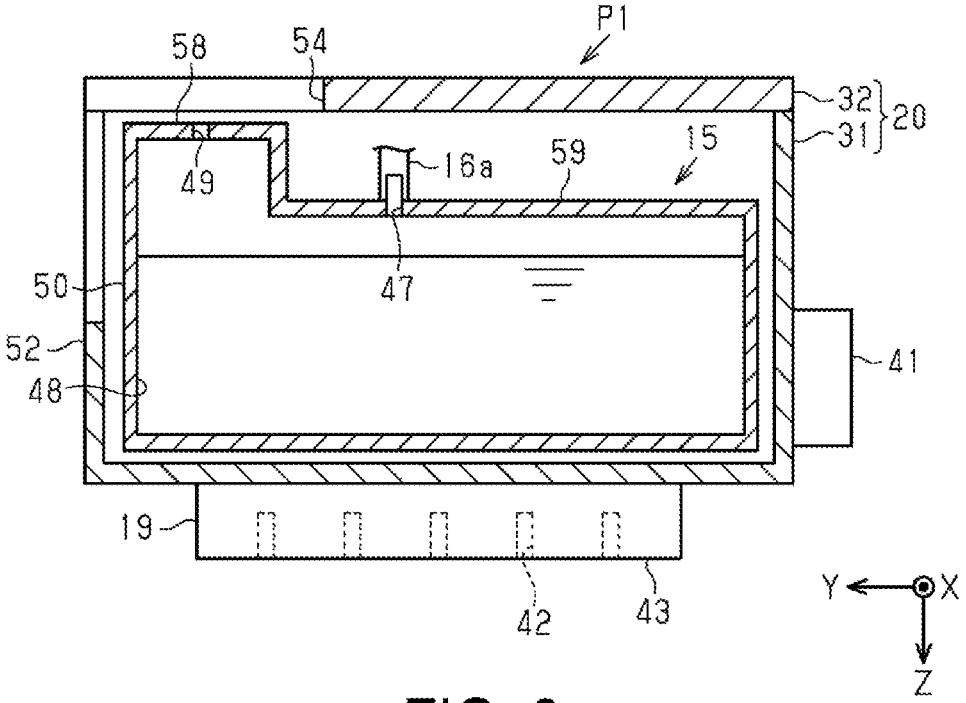
FIG. 9 is a schematic view of modification examples of the second ink storage unit and the carriage.

As illustrated in FIG. 9, when the lid member 32 is at the first position P1, the lid member 32 may cover the downstream end 16*a* of the tube 16 coupled to the ink supplying port 47 and expose the communication hole 49 via the notch 54.

Figure 10:
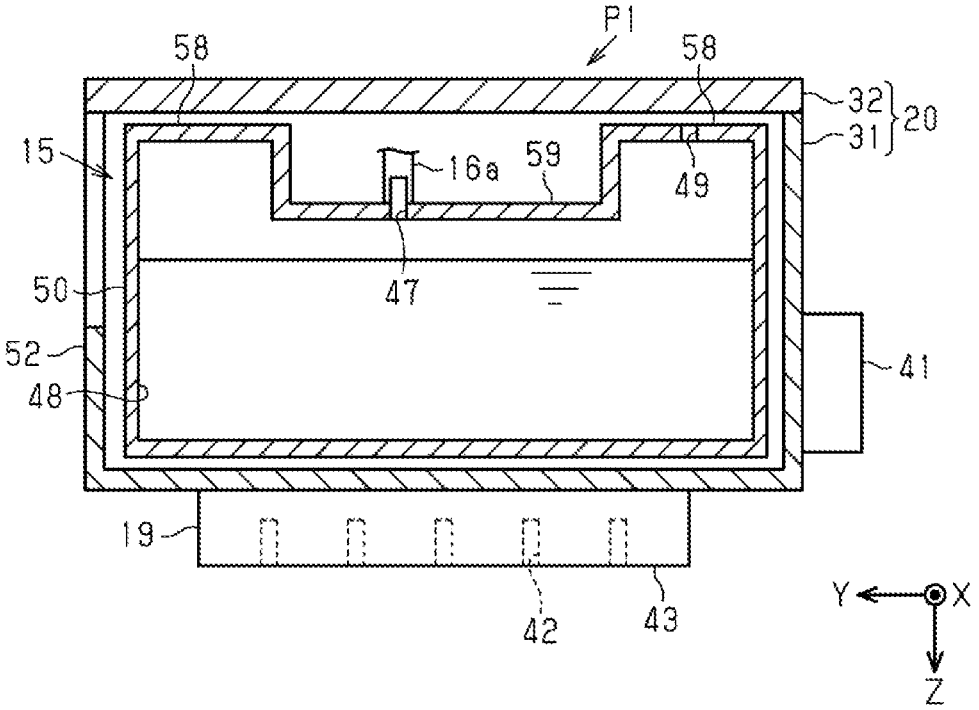
FIG. 10 is a schematic view of modification examples of the second ink storage unit and the carriage.

As illustrated in FIG. 10, the second ink storage unit 15 may include a plurality of the high-back portions 58. The ink supplying port 47 may be provided in a low-back portion 59 located between a plurality of high-back portions 58. The communication hole 49 may be provided in a high-back portion 58 located at the rear or in a high-back portion 58 located at the front.

Figure 11:
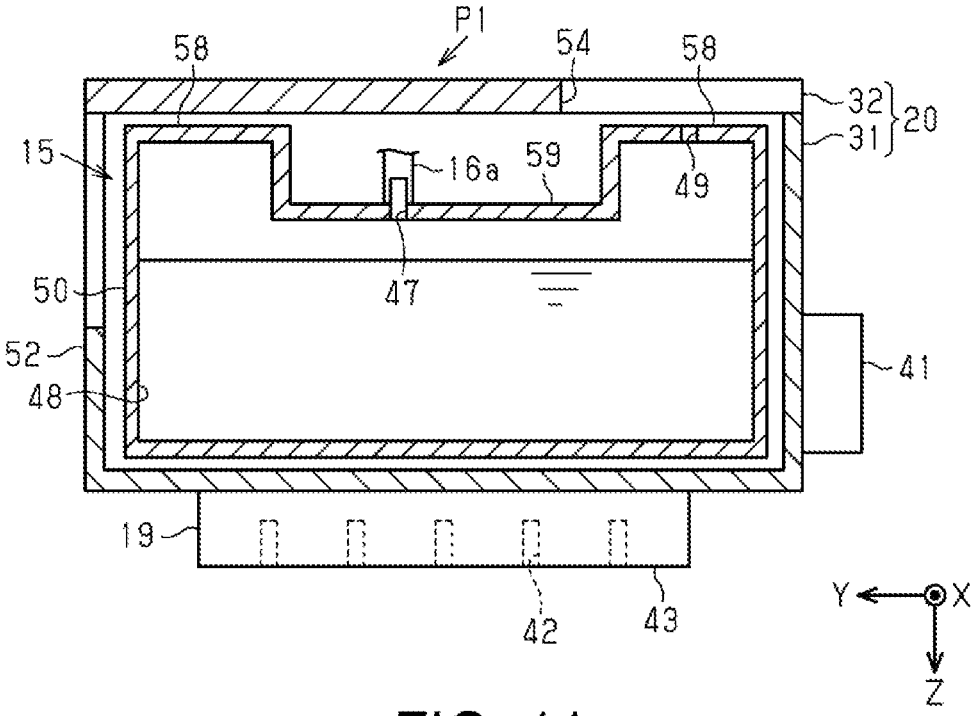
FIG. 11 is a schematic view of modification examples of the second ink storage unit and the carriage.

As illustrated in FIG. 11, the lid member 32 may include the notch 54 provided at the rear and may expose the communication hole 49 from the notch 54.

The ink supplying port 47 may be formed in a side wall between the high-back portion 58 and the low-back portion 59 so as to be open toward the front or the rear.

The second ink storage unit 15 may have a configuration in which the ink supplying port 47 and the communication hole 49 are provided in the high-back portion 58.

The second ink storage unit 15 may have a configuration in which the ink supplying port 47 is provided in the high-back portion 58 and the communication hole 49 is provided in the low-back portion 59.

The lid member 32 may be detachable from the mounting portion 31. The lid member 32 may be located at the first position P1 when attached to the mounting portion 31 or the second position P2 when removed from the mounting portion 31. The lid member 32 may slide relative to the mounting portion 31.

The lid member 32 may rotate about an axis located at a rear end of the lid member 32 while the lid member 32 is at the first position P1, or may rotate about an axis parallel to the Y-axis.

The printer cover 26 may be removably disposed on the housing 12. The printer cover 26 may be located at the cover position CP when mounted to the housing 12 and covering the opening 22, or the open position OP when removed from housing 12. The printer cover 26 may slide relative to the mounting portion 31.

The display unit 28 and the light-transmissive surface 50 may face different directions. The light-transmissive surface 50 may face a direction different from the front. The light-transmissive surface 50 may be formed as at least one of a front side, a rear side, a scanning direction X side, and a side opposite to the scanning direction X of the second ink storage unit 15. The light-transmissive surface 50 may be formed in the second ink storage unit 15 through corner chamfering. For example, the second ink storage unit 15 may have a surface inclined with respect to the X-axis and the Y-axis between the XZ-plane on a front side and the YZ-plane on a scanning direction X side, and this surface may be the light-transmissive surface 50. The light-transmissive surface 50 is not limited to a flat surface and may be a curved surface. In the second ink storage unit 15, when, for example, a side surface on the scanning direction X side is used as the light-transmissive surface 50, a side surface of the carriage 20 located between the second ink storage unit 15 and the second outer cover member 12*b* partially covers the light-transmissive surface 50.

The ink supply unit 13 may include a pump that pressurizes the ink stored in the first ink storage unit 14, and the ink may be pressure-fed from the first ink storage unit 14 to the second ink storage unit 15. The ink supply unit 13 may supply the ink stored in the first ink storage unit 14 to the second ink storage unit 15 using a head of water.

The carriage 20 may be provided with a discharge flow path that discharges ink that has leaked from the second ink storage unit 15 to outside of the carriage 20. The discharge flow path may be coupled to a cap provided to allow a user to perform maintenance on the discharge head 19, or a waste liquid tank for storing the liquid discharged from the discharge head 19 to perform maintenance.

Hereinafter, technical concepts and effects thereof that are understood from the above-described exemplary embodiments and modified examples will be described.

The printer includes a first ink storage unit storing ink, a second ink storage unit storing the ink supplied from the first ink storage unit, a discharge head configured to discharge the ink, a carriage configured to move the discharge head and the second ink storage unit, and a tube coupling the first ink storage unit and the second ink storage unit. The second ink storage unit includes an ink supplying port coupled to the tube, a communication hole making inside and the outside of the second ink storage unit, and a light-transmissive surface which is transparent or translucent. The ink stored in the second ink storage unit is visible from outside the second ink storage unit through the light-transmissive surface, and the communication hole and a portion of the light-transmissive surface are located vertically above a side surface of the carriage when the second ink storage unit is mounted on the carriage.

According to this configuration, the communication hole and a portion of the light-transmissive surface in the second ink storage unit are exposed when the second ink storage unit is mounted on the carriage. Thus, for example, when the second ink storage unit is depressurized via the communication hole and ink is drawn from the first ink storage unit to the second ink storage unit, the amount of ink in the second ink storage unit can be visually recognized, by the user, through the light-transmissive surface. Accordingly, it is possible to reduce the risk of the ink supplied to the second ink storage unit leaking from the second ink storage unit.

The printer may further include an outer cover member provided with a discharge port through which a printed medium is discharged, and the side surface of the carriage may be located between the light-transmissive surface and the outer cover member in a normal direction orthogonal to the side surface.

According to this configuration, the side surface of the carriage that covers a portion of the light-transmissive surface is located between the light-transmissive surface and the outer cover member formed with the discharge port. Thus, a user who is at a position where the user can collect the medium discharged from the discharge port can easily view the light-transmissive surface.

The printer may further include a display unit configured to display information. The light-transmissive surface may be a front side surface of the second ink storage unit, and the information displayed on the display unit may be visible from a position in front of the display unit.

According to this configuration, the light-transmissive surface is a front side surface of the second ink storage unit. Information displayed on the display unit is visible from a position in front of the display unit. Thus, a user who is at a position where the user can view the information displayed on the display unit can easily view the light-transmissive surface.

In the printer, the ink supplying port may be located closer to the light-transmissive surface than the communication hole is.

In a case where, for example, the second ink storage unit is depressurized via the communication hole and ink is drawn from the first ink storage unit to the second ink storage unit, ink can be supplied from the first ink storage unit to the second ink storage unit using the siphon principle provided that the tube can be filled with ink. In this regard, the ink supplying port is positioned closer to the light-transmissive surface than the communication hole. Thus, it is possible to reduce the risk of the tool used for depressurizing the inside of the second ink storage unit through the communication hole or the hand of an operator handling the tool covering the ink supplying port and the tube coupled to the ink supplying port. As a result, good operability can be ensured.

In the printer, the communication hole may be located closer to the light-transmissive surface than the ink supplying port is.

According to this configuration, the communication hole is located closer to the light-transmissive surface than the ink supplying port. The communication hole is easily visible from the light transmission surface side. Thus, for example, the user can easily visually recognize that ink is likely to adhere to the tool inserted into the communication hole, and it is possible to reduce the risk of ink adhering to the tool. Additionally, even when ink has adhered to the tool inserted into the communication hole, the user can easily visually recognize that the ink has adhered to the tool. Thus, it is possible to reduce the risk of ink splattering when the tool is withdrawn from the communication hole.

In the printer, the carriage may include a lid member movable to a first position and to a second position. When the lid member is at the first position, the lid member may locate vertically above the communication hole and cover the communication hole and, when the lid member is at the second position, the lid member may expose the communication hole.

According to this configuration, the carriage includes a lid member that covers the communication hole. Thus, it is possible to reduce the risk of foreign material adhering to the communication hole and foreign material entering the second ink storage unit through the communication hole.

The printer may include a housing, provided with an opening located vertically above the carriage located at a predetermined position, and including a printer cover movable to a cover position at which the printer cover covers the opening, and an open position different to the cover position. The carriage may include a lid member movable to a first position and to a second position and, when the printer cover is at the open position, the communication hole may be exposed regardless of the position of the lid member.

According to this configuration, the housing includes a printer cover that covers an opening located vertically above the carriage. Thus, the communication hole is covered by the printer cover when the printer cover is at the cover position, even if the communication hole is exposed regardless of the position of the lid member. As a result, it is possible to reduce the risk of foreign material adhering to the communication hole and foreign material entering the second ink storage unit through the communication hole.

In the printer, the carriage may include a lid member movable to a first position and to a second position and, when the lid member is at the first position, the lid member may locate vertically above the ink supplying port and cover the ink supplying port.

According to this configuration, the lid member covers the ink supplying port when at the first position. Thus, it is possible to reduce the risk of, for example, an external force acting on the coupling portion between the ink supplying port and the tube and, as a result, the tube becoming detached from the ink supplying port.

In the printer, when the lid member is at the first position, the lid member may locate a vertical above the ink supplying port and cover the ink supplying port.

According to this configuration, the lid member located in the first position covers the ink supplying port. Thus, for example, it is possible to reduce the risk of, for example, an external force acting on the coupling portion between the ink supplying port and the tube and, as a result, the tube becoming detached from the ink supplying port.

An ink supply unit includes a first ink storage unit storing ink, a second ink storage unit storing the ink supplied from the first ink storage unit, and a tube coupling the first ink storage unit and the second ink storage unit, the second ink storage unit including an ink supplying port coupled to the tube, a communication hole communicating internally and externally with the second ink storage unit, and a light-transmissive surface which is transparent or translucent. And, the ink stored in the second ink storage unit is visible from outside the second ink storage unit through the light-transmissive surface, and the communication hole and a portion of the light-transmissive surface are located vertically above a side surface of a carriage while the second ink storage unit is mounted to the carriage, the carriage being configured to move a discharge head configured to discharge the ink.

According to this configuration, the same effect as the printer described above can be obtained.

What is claimed is:

1. A printer comprising:

a first ink storage unit configured to store ink;

a second ink storage unit configured to store the ink supplied from the first ink storage unit;

a discharge head configured to discharge the ink;

a carriage configured to move the discharge head and the second ink storage unit, the carriage comprising a lid member having a notch; and a tube coupling the first ink storage unit and the second ink storage unit, wherein the second ink storage unit including an ink supplying port to which the tube is coupled, a communication hole making inside and outside of the second ink storage unit communicate with each other, the communication hole being positioned vertically higher than the ink supplying port and disposed vertically below the notch of the lid member, and a light-transmissive surface which is transparent or translucent, the ink stored in the second ink storage unit is visible from outside the second ink storage unit through the light-transmissive surface; and the communication hole and a portion of the light-transmissive surface are located at a position vertically higher than a side surface of the carriage in a state where the second ink storage unit is mounted on the carriage.

2. The printer according to claim 1, further comprising an outer cover member provided with a discharge port through which a printed medium is discharged, wherein the side surface of the carriage is located between the light-transmissive surface and the outer cover member in a normal direction orthogonal to the side surface.

3. The printer according to claim 1, further comprising a display unit configured to display information, wherein the light-transmissive surface is a front side surface of the second ink storage unit; and the information displayed on the display unit is visible from a position in front of the display unit.

4. The printer according to claim 1, wherein the ink supplying port is located closer to the light-transmissive surface side than the communication hole is located.

5. The printer according to claim 1, wherein the communication hole is located closer to the light-transmissive surface side than the ink supplying port is located.

6. The printer according to claim 1, wherein the lid member is movable to a first position and to a second position, and when the lid member is at the first position, the notch of the lid member locates vertically above the communication hole.

7. The printer according claim 1, further comprising a housing, provided with an opening located at a position vertically higher than the carriage that is located at a predetermined position including a printer cover movable to a cover position at which the printer cover covers the opening, and to an open position, which is different from the cover position, wherein when the printer cover is at the open position, the communication hole is exposed regardless of the position of the lid member.

8. The printer according to claim 1, wherein the lid member is movable to a first position and to a second position, and when the lid member is at the first position, the lid member locates vertically above the ink supplying port and covers the ink supplying port.

9. The printer according to claim 6, wherein, when the lid member is at the first position, the lid member locates vertically above the ink supplying port and covers the ink supplying port.

10. An ink supply unit comprising:

a first ink storage unit configured to store ink;

a second ink storage unit configured to store the ink supplied from the first ink storage unit; and a tube coupling the first ink storage unit and the second ink storage unit, wherein the second ink storage unit including:

a high-back portion and a low-back portion, the high-back portion being positioned vertically higher than the low-back portion;

an ink supplying port to which the tube is coupled, the ink supplying port is disposed at the low-back portion;

a communication hole making inside and outside of the second ink storage unit communicate with each other, the communication hole being positioned vertically higher than the ink supplying port; and a light-transmissive surface which is transparent or translucent, the ink stored in the second ink storage unit is visible from outside the second ink storage unit through the light-transmissive surface, and the communication hole and a portion of the light-transmissive surface are located at a position vertically higher than a side surface of a carriage in a state where the second ink storage unit is mounted on the carriage, the carriage being configured to move a discharge head configured to discharge the ink.

11. The printer according to claim 1, wherein the tube moves with movement of the carriage.

12. The printer according to claim 10, wherein the tube moves with movement of the carriage.

* * * * *